US010617585B2

(12) United States Patent
Hampe et al.

(10) Patent No.: US 10,617,585 B2
(45) Date of Patent: Apr. 14, 2020

(54) THERMOTHERAPY DEVICE COMPRISING A PIVOTABLE WALL

(71) Applicant: Drägerwerk AG & Co. KGaA, Lübeck (DE)

(72) Inventors: Markus Hampe, Lübeck (DE); Tjeerd Jan Pieter Gerbranda, Blaustein (DE); Eduard Engelsman, Lübeck (DE); Danker Kemper, Delft (NL); Jeroen Oomen, Capelle aan den Ijssel (NL)

(73) Assignee: DRÄGERWERK AG & CO. KGAA, Lübeck (DE)

( * ) Notice: Subject to any disclaimer, the term of this patent is extended or adjusted under 35 U.S.C. 154(b) by 273 days.

(21) Appl. No.: 15/603,795

(22) Filed: May 24, 2017

(65) Prior Publication Data

US 2017/0340499 A1 Nov. 30, 2017

(30) Foreign Application Priority Data

May 25, 2016 (DE) ..... 10 2016 006 312

(51) Int. Cl.
*A61G 11/00* (2006.01)

(52) U.S. Cl.
CPC ..... *A61G 11/006* (2013.01); *A61G 2210/50* (2013.01)

(58) Field of Classification Search
CPC ..... A61G 2210/50; A61G 11/006
USPC ..... 600/21–22
See application file for complete search history.

(56) References Cited

U.S. PATENT DOCUMENTS 5,112,293 A * 5/1992 Vaccaro ..... A61G 11/00 128/205.26
6,234,954 B1 * 5/2001 Mackin ..... A61G 11/006 600/22
6,540,660 B1 * 4/2003 Speraw ..... A61G 11/00 600/22
6,611,978 B1 * 9/2003 Schmidt ..... A61G 11/00 5/603

(Continued)

FOREIGN PATENT DOCUMENTS

CN 101721289 A 6/2010
CN 102525774 A 7/2012

(Continued)

*Primary Examiner* — Navin Natnithithadha
*Assistant Examiner* — Sunita Reddy
(74) *Attorney, Agent, or Firm* — McGlew and Tuttle, P.C.

(57) ABSTRACT

A thermotherapy device (1) includes a pivotable wall (2) and a pivoting device (3). The pivoting device (3) has a pivoting axis section (31) connected to the thermotherapy device. A locking element (32) is connected to the pivotable wall (2) and is mounted movably radially to the pivoting axis section (31) and pivotably about the pivoting axis section (31). A blocking element (33) and a holding module (34) for the blocking element (33) are provided. A contact element (35) is permanently connected to the locking element (32) for contacting the blocking element (33). The holding module (34) pushes the blocking element (33) between the pivoting axis section (31) and the contact element (35) when the locking element (32) is moved from a locked position, defined by a first distance to the pivoting axis section (31), into an unlocked position, defined by a second distance to the pivoting axis section (31).

17 Claims, 9 Drawing Sheets

(56) References Cited

U.S. PATENT DOCUMENTS 6,880,188 B1* 4/2005 Schmidt ..... A61B 6/4283 177/144
2002/0017248 A1 2/2002 Honma et al.
2002/0062523 A1* 5/2002 Prows ..... A61G 11/00 5/658
2002/0072648 A1* 6/2002 Dykes ..... A61G 11/00 600/22
2004/0236175 A1* 11/2004 Boone ..... A61B 5/02055 600/22
2005/0020872 A1* 1/2005 Hampe ..... A61G 11/00 600/22
2005/0070756 A1* 3/2005 Falk ..... A61G 11/00 600/22
2010/0249492 A1* 9/2010 Khodak ..... A61G 11/00 600/22
2010/0249493 A1* 9/2010 Chilton, III ..... A61G 11/00 600/22
2012/0269568 A1* 10/2012 Matsubara ..... A61G 11/006 403/104
2015/0065787 A1* 3/2015 Bohnen ..... A61G 11/00 600/22
2015/0300064 A1* 10/2015 Edavana ..... E05D 3/022 16/231
2016/0030264 A1* 2/2016 Lehmann ..... A61M 16/161 600/22

FOREIGN PATENT DOCUMENTS

DE 69612791 T2 10/2001
DE 101 33 553 A1 1/2002
DE 698 28 981 T2 3/2006
DE 10 2012 216 473 A1 3/2014
EP 0368207 A2 5/1990
EP 0749743 A2 12/1996
EP 2514399 A2 10/2012

* cited by examiner

A - A

B - B

THERMOTHERAPY DEVICE COMPRISING A PIVOTABLE WALL

CROSS REFERENCE TO RELATED APPLICATIONS

This application claims the benefit of priority under 35 U.S.C. § 119 of German Application 10 2016 006 312.2, filed May 25, 2016, the entire contents of which are incorporated herein by reference.

FIELD OF THE INVENTION

The present invention pertains to a thermotherapy device comprising a pivotable wall and a pivoting device for the pivotable wall, wherein the pivoting device has a pivoting axis section connected to the thermotherapy device and a locking element connected to the pivotable wall, which can be moved radially towards the pivoting axis section and is mounted pivotably about the pivoting axis section.

BACKGROUND OF THE INVENTION

Thermotherapy devices, and in particular incubators, are used to treat patients having a weakened thermoregulation. In particular, infants as well as premature babies depend on staying in a warm environment. For this purpose, thermotherapy devices comprise an interior, which is defined by a reclining surface, which is enclosed by side walls. The side walls prevent a patient from being able to fall out of the reclining surface or the thermotherapy device. Further, thermotherapy devices have a heater. In order to separate the interior of the thermotherapy device from the outside world, the thermotherapy devices may have a closed configuration, i.e., the reclining surface is spanned over by a cover or a hood. In case a hood spans over the reclining surface, access to the patient is granted by opening the hood, on the one hand, or by opening the side walls, on the other hand. For this purpose, rotatable side walls are provided, the pivoting axes of which are located at the lower end of the side wall. The corresponding side wall can in this case be swung out about an axis of rotation arranged below the side wall. Below the side walls of the thermotherapy device, an X-ray flap is usually provided, which makes possible access to an X-ray drawer arranged under the patient bed, into which an X-ray cassette can be inserted to X-ray the patient in the thermotherapy device. The side walls must further be able to be opened independently of the X-ray flap. Further, a locking of the side wall is needed, so that the side wall is held securely and does not carry out any uncontrolled opening motions when the patient or a care provider presses against the side wall from the interior.

To this end, providing simple snap closures at the side walls, which lock the side wall, is known. A drawback of these snap closures is that they have to be actuated with both hands with effort or that at least two actuation steps are needed to open the snap closure.

A pivotable side wall, which can be used for a thermotherapy device without a hood, is known from DE 10 2012 216 473 A1. The hinge of the pivotable wall is guided in a long track, which is oriented vertically. The side wall with the hinge can hence be raised vertically upwards. Further, a closing pin, which meshes with a snap-in projection at the thermotherapy device when the side wall is closed, is provided at the side wall. By raising the side wall, the closing pin is lifted out of the snap-in projection, so that the side wall can be pivoted. A drawback of this device is that it cannot be used with a hood because a raising of the side wall in the vertical direction is not possible in case of a hood. The further locking mechanisms mentioned in this publication are complicated to operate, so that they cannot be used with one hand or with one actuation step.

SUMMARY OF THE INVENTION

The object of the present invention is therefore to create a device, which provides a locking element, which can be operated with one hand in a simple manner, for pivotable walls of a thermotherapy device and can be actuated in case of a closed hood.

According to the invention, a thermotherapy device is provided comprising a pivotable wall and a pivoting device for the pivotable wall. The pivoting device includes a pivoting axis section connected to the thermotherapy device and a locking element connected to the pivotable wall. The locking element is mounted movably radially to the pivoting axis section and pivotably about the pivoting axis section. Provisions are made according to the present invention for the pivoting device to comprise a blocking element, a holding module for the blocking element and a contact element permanently connected to the locking element for contacting the blocking element, wherein the holding module pushes the blocking element between the pivoting axis section and the contact element when the locking element is moved from a locked position defined by a first distance to the pivoting axis section into an unlocked position defined by a second distance to the pivoting axis section.

The present invention has recognized that a movability of the pivotable wall in the radial direction in relation to the pivoting axis section with simultaneous pivotability about the pivoting axis section makes possible a simple operation of the locking element with one hand. Starting from the locked position, in which the pivotable wall is locked at the thermotherapy device by means of the locking element, the locking element can be transferred into the unlocked position by means of a radial motion in relation to the pivoting axis section, in which unlocked position, the locking of the locking element, and thus of the pivotable wall with the thermotherapy device is canceled. In this case, one motion, which has a radial component, is sufficient. The first distance, which the locking element has from the pivoting axis section, is transferred by this radial motion into the second distance. When the locking element is moved into the unlocked position starting from the locked position in the radial direction in relation to the pivoting axis section, the blocking element is further pushed by the holding module between the contact element at the locking element and the pivoting axis section, i.e., as soon as the locking element is moved with a motion having a radial component in relation to the pivoting axis, the holding module is actuated. In this case, the contact element is configured for contacting the blocking element. As soon as the blocking element is arranged between the pivoting axis section and the contact element, the locking element cannot be moved further in the radial direction in relation to the pivoting axis section. The blocking element hence blocks the motion of the locking element in the radial direction. Here, the blocking element in any case blocks a motion of the locking element towards the pivoting axis section. In addition, the blocking element can block a motion of the locking element away from the pivoting axis section.

When the blocking element is arranged between the pivoting axis section and the contact element, the locking element or the pivotable wall is in the unlocked position and thus makes possible a pivoting of the locking element into a pivoted position from which the pivotable wall is freely pivotable. In this case, the pivotable wall and the locking element are connected to the thermotherapy device only via the pivoting axis section and are freely pivotable about the pivoting axis section. In the pivoted position, the locking element is held at a constant distance from the pivoting axis section during the pivoting. The blocking element is carried along here during a pivoting of the locking element after leaving the locked position, i.e., the blocking element is simultaneously pivoted with the locking element, as soon as it is arranged between the pivoting axis section and the contact element. The pivoted position thus differs from the unlocked position in that the blocking element in the pivoted position blocks the radial motion of the locking element towards the pivoting axis section. By means of the blocking element, the locking element is automatically held at a constant distance to the pivoting axis section, which essentially corresponds to the second distance that the locking element has from the pivoting axis section in the unlocked position. It is thus not necessary to move the pivotable wall or the locking element in a radial direction between the pivoted position and the unlocked position. Further, the pivotable wall and thus the locking element is held in a stable manner at a constant radial distance to the pivoting axis section, while it is pivoted from the unlocked position into the pivoted position. Thus, a rattling due to a pivoting axis being loose in the radial direction or due to loose parts at the locking element is avoided. The pivotable wall can thus be guided with a single handle from the locked position into the unlocked position and then be displaced into the pivoted position.

During the closing of the pivotable wall at the thermotherapy device, the blocking element, during the transfer from the pivoted position into the unlocked position, causes the locking element or the pivotable wall to have a defined distance to the pivoting axis section and not to carry out a motion in the radial direction. A simple automatic transfer of the pivotable wall from the pivoted position into the unlocked position is thus brought about. A user does not need to tediously move the pivotable wall in the radial direction during the closing operation when he would like to transfer the pivotable wall from the pivoted position into the unlocked position. To reach the locked position from the pivoted position via the unlocked position, the user only has to detach the blocking element from the position between the contact element and the pivoting axis section, so that a motion of the locking element in the radial direction is possible again. This can be carried out by means of a suitable radial/pivoting motion. Thus, the present invention has the advantage that the pivotable wall can be opened and closed with one hand. Further, a combined radial/pivoting motion is made possible due to the pivotability of the locking element, so that the pivotable wall can also be used with a closed hood.

The first distance is advantageously shorter than the second distance. To transfer the pivotable wall from the locked position into the unlocked position, the distance that the locking element in the locked position has from the pivoting axis section must in this case be increased. The transfer from the locked position into the unlocked position can thus be carried out, for example, with a combined radial/pivoting motion, wherein the radial motion moves the pivotable wall away from the pivoting axis section.

Furthermore, the pivoting device advantageously has a radial guide element for guiding the locking element in the radial direction in relation to the pivoting axis section, the radial guide element being mounted pivotably about the pivoting axis section. The radial guide element may comprise here a guide groove, wherein the locking element can comprise a pin, which is mounted slidingly in the guide groove. The locking element is then connected to the pivoting axis section via the radial guide element. Thus, the locking element can be moved in a guided motion radially in relation to the pivoting axis section. This increases the stability and thus the operability of the pivoting device.

A bolt element is advantageously connected permanently to the thermotherapy device, wherein the locking element comprises a sliding guide element for the bolt element. As an alternative, the locking element may comprise a bolt element, which is guided in a sliding guide element, which is permanently connected to the thermotherapy device. In this way, the motion of the locking element from the locked position into the unlocked position and vice versa can be guided by means of the sliding guide element. Thus, the motion of the locking element along the bolt element can take place in a precisely defined trajectory, which ensures, on the one hand, an unlocking of the locking element from the thermotherapy device and, on the other hand, makes possible a defined motion of the pivotable wall past the hood during unlocking or during the moving out of the locked position. The guided motion makes it easier for the user to carry out the locking or unlocking.

Further, the sliding guide element comprises an open end and a closed end, wherein between the open end and the closed end is arranged an instability element, which pushes the locking element either into the locked position or into the unlocked position in case of arrangement at the bolt element. The closed end is preferably arranged in relation to the instability element such that the sliding guide element guides the locking element out of the locked position simultaneously with a radial component and a tangential component about the pivoting axis section. The sliding guide element is then configured such that the pivotable wall is first raised from the locked position, guided past the hood on the outside and is then deposited onto the blocking element into the unlocked position. When the locking device is transferred from the unlocked position into the pivoted position, the bolt element is released from the sliding guide element. In case of a reversed motion from the pivoted position into the unlocked position, the bolt element is inserted into the sliding guide element. In case of a further motion into the locked position, the locking device or the contact element is first lifted off from the blocking element and then removed from the blocking element and deposited into the locked position. The instability element forms a dead center, which is preferably configured as an acute angle.

In other words, at the dead center, which is located between the locked position and the unlocked position, the locking element automatically moves either into the locked position or into the unlocked position due to the weight of the pivotable wall. Staying at the dead center is not possible for the locking element and thus the pivotable wall. This increases the safety of operation because the pivotable wall is either unambiguously closed or unambiguously open. Accordingly, a user cannot inadvertently bring about an unnoticed opened state, which, if it is not discovered, may become a health risk for the patient.

The bolt element is advantageously configured as a ball bearing. Thus, the friction between the bolt element and the sliding guide element is reduced. This increases the ease of motion, increases the action of the instability element and reduces the generation of noise of the holding device during the actuation of the pivotable wall.

Further, it is advantageous to arrange a damping element at the pivoting device, which damps the motion of the locking mechanism during the transfer from the unlocked position into the locked position and brings about the contact between the locking element and the thermotherapy device. Further, the placing of the pivotable wall against the hood is thereby carried out with a damped motion. Thus, loud noises during the closing of the pivotable wall are avoided.

The pivoting device advantageously comprises a retaining element for blocking the pivoting motion of the blocking element before reaching the locked position. By means of the retaining element, the blocking element is pushed from the area between the contact element and the pivoting axis section during a pivoting from the unlocked position into the locked position of the locking element. Here, it is preferable when the retaining element is configured as a retaining piece, which is permanently connected to the pivoting axis section and which blocks a pivoting motion of the blocking element before reaching the locked position of the locking element during a pivoting of the locking element from the unlocked position into the locked position, i.e., the blocking element in the locked position of the locking element does not have the same angular orientation as the locking element or the pivotable side wall.

The blocking element is advantageously mounted pivotably about the pivoting axis section, wherein the holding module is configured as a tension spring, which acts on a lever piece of the blocking element, wherein the lever piece is arranged eccentrically to the pivoting axis section. Thus, a torque can be exerted onto the blocking element in a simple manner when the locking element is moved radially away from the pivoting axis section. Here, the tension spring is permanently connected to the locking element with the other end. As an alternative, the holding module may be configured as a coil spring or as a motor. A pulling module advantageously pushes the pivotable wall towards the pivoting axis section by means of a tensile force that is greater than the weight of the pivotable wall, wherein the pulling module is preferably made in one piece with the holding module. The pivotable wall is then also pushed towards the pivoting axis section by means of the pulling module when the pivotable wall is arranged below the pivoting axis section. In this case, the pulling module is configured such that the force exerted by the pulling module exceeds the weight of the pivotable wall, so that the pivotable wall is raised by the pulling module in the direction of the pivoting axis section. Further, the locking force in the locked position is increased by the pulling module.

The blocking element is advantageously configured as a pawl. A pawl can be pivoted without great effort about the pivoting axis section by means of a holding module and arranged between the contact element and the pivoting axis section.

The locking element is advantageously configured as a hinge housing part. In this way, the locking element can be manufactured in a simple manner. The contact element and the sliding guide element as well as the pin may here be made in one piece with the housing part. This facilitates the mounting and assembly of the pivoting device because the pin, the contact element and the sliding guide stand together in a fixed positional relationship. Further, the generation of noise during the operation is reduced thereby because the parts are not movable towards one another.

The thermotherapy device advantageously comprises an X-ray flap pivotable about the pivoting axis section between the pivoting axis section and the pivotable wall. Further, a labyrinth seal may be arranged between the X-ray flap and the pivotable wall. In this way, a gap, from which warm air can flow out from the thermotherapy device into the cold surrounding area and can thereby cool off the interior of the thermotherapy device, is prevented from forming between the X-ray flap and the pivotable wall. Conversely, cold air from the surrounding area is thus prevented from penetrating into the interior of the thermotherapy device as well. Arranging a labyrinth seal at a thermotherapy device with the hood closed is made possible for the first time by the present invention. This is due to the fact that the present invention can move a pivotable wall in a combined radial motion and pivoting motion from the locked position. If this combined motion were not possible, a labyrinth seal could not be provided at the X-ray flap.

The thermotherapy device advantageously comprises a hood, which can be lifted off from the thermotherapy device, and a sealing lip arranged obliquely at the pivotable wall is arranged between the pivotable wall and the hood. The sealing lip can in this case be fastened either to the hood or to the pivotable wall.

The contact element is advantageously configured as a contact collar running tangentially to the pivoting axis. The blocking element is then held securely in case of arrangement between the pivoting axis section and the contact element because the contact element provides a contact collar running tangentially to the pivoting axis as a stable contact surface.

At least two pivoting devices are advantageously provided for a pivotable wall, the pivoting devices being connected to one another by means of a coupling element, which is preferably configured as a crankshaft, the coupling element being mounted in a sliding manner in guide tracks at the pivoting devices running tangentially to the pivoting axis section. The guide tracks are advantageously arranged at the radial guide elements of the pivoting device. Further, the coupling element is mounted rotatably at the locking element. The motion of the two pivoting devices is synchronized by the coupling element, so that the wall can be moved without tilting.

The present invention is explained in more detail based on an advantageous exemplary embodiment by means of the attached drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1B:
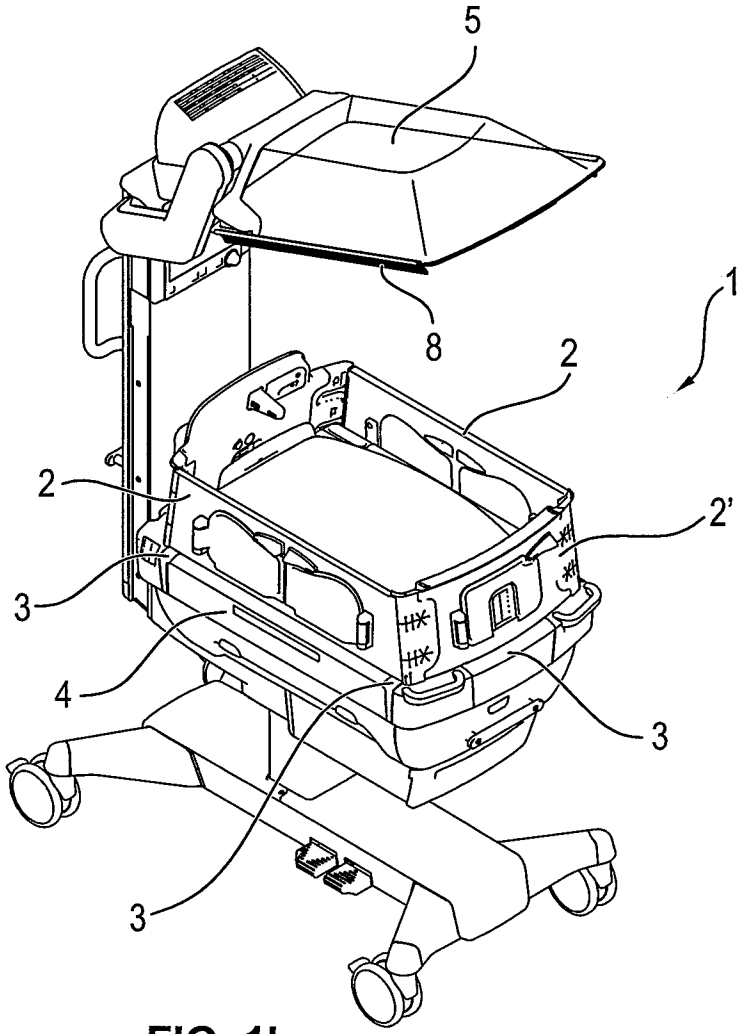
FIG. 1*b* is a schematic view of a thermotherapy device with an open hood and pivotable side walls.

Referring to the drawings, the thermotherapy device is identified in its entirety with reference number 1. The thermotherapy device 1 comprises a pivotable wall 2, a pivoting device 3 for the pivotable wall 2, which connects the pivotable wall 2 to the thermotherapy device 1, an X-ray flap 4 arranged below the pivotable wall 2 and a hood 5. Further, the thermotherapy device 1 comprises a southern pivotable wall 2' (see FIG. 1*a*). The thermotherapy device 1 may further comprise a plurality of pivotable walls 2 with pivoting devices 3, wherein the pivotable walls 2 may further have each a plurality of pivoting devices 3.

Figure 1A:
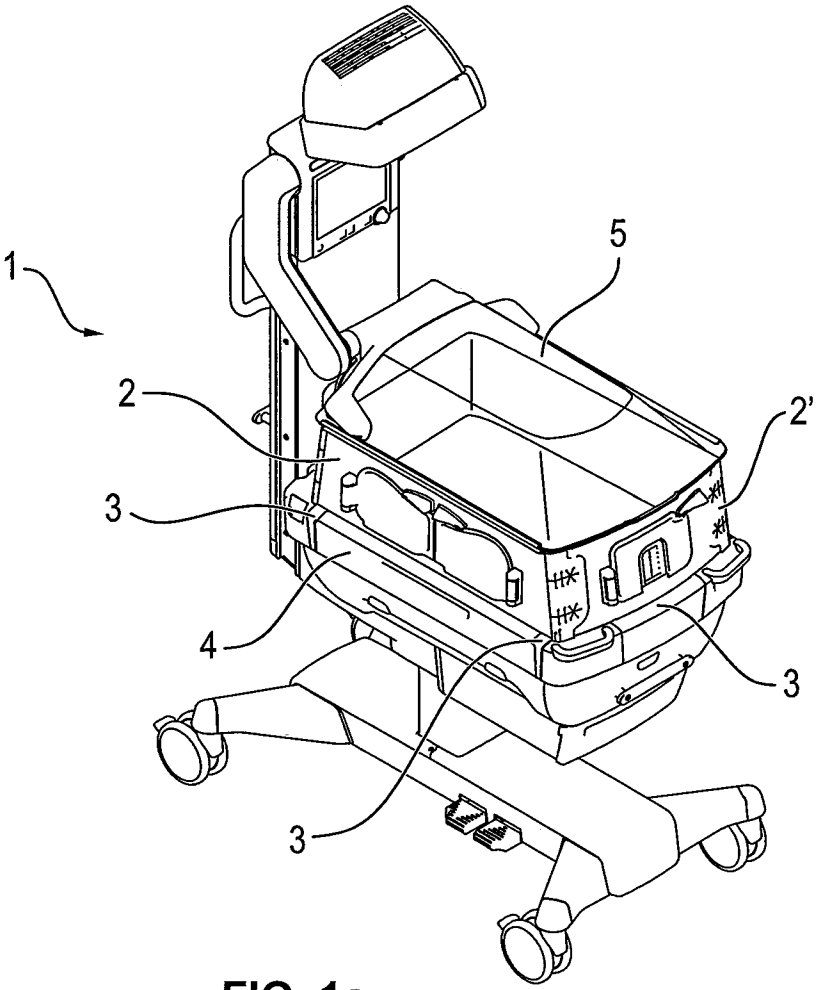
FIG. 1*a* is a schematic view of a thermotherapy device with a closed hood and pivotable side walls.

FIG. 1*a* shows the hood 5 in the lowered state. The thermotherapy device 1 is thus closed in FIG. 1*a*. FIG. 1*b* shows the thermotherapy device 1 open, i.e., that the hood 5 is raised from the thermotherapy device 1. The interior of the thermotherapy device 1 is accessible from above in this case.

Further, the pivotable wall 2 can be pivoted, i.e., that the pivotable wall 2 can be swung out. In this case, the pivotable wall 2 can be swung out when the hood 5 is lowered or when the hood 5 is raised from the thermotherapy device 1. The thermotherapy device 1 comprises the pivoting device 3 for pivoting the pivotable wall 2. For this purpose, the pivoting device 3 is fastened to the lower side of the pivotable wall 2.

In this embodiment, a sealing lip 8, which is provided for contacting a pivotable wall 2, is further arranged at the hood 5. The sealing lip 8 is in contact with the pivotable wall 2 when the hood 5 is lowered. The sealing lip 8 is in contact here with the lateral side of the pivotable wall 2, so that a gap between the hood 5 and the pivotable wall 2 is sealed by the sealing lip 8. The sealing lip 8 runs obliquely between the pivotable wall 3 and the hood 5, so that the pivotable wall 2 is pressed against the tilted sealing lip 8 during the pivoting towards the hood 5. Further, when the pivotable wall 2 is closed, the sealing lip 8 is guided along due to tilting against the pivotable wall 2 during the closing of the hood 5, and a sealing action occurs between the pivotable wall 2 and the hood 5 in the closed position of the hood 5 at the latest.

In an alternative embodiment, not shown, the sealing lip 8 is connected to the pivotable wall 2. The function and action of the sealing lip 8 is analogous to that described above.

Figure 2A:
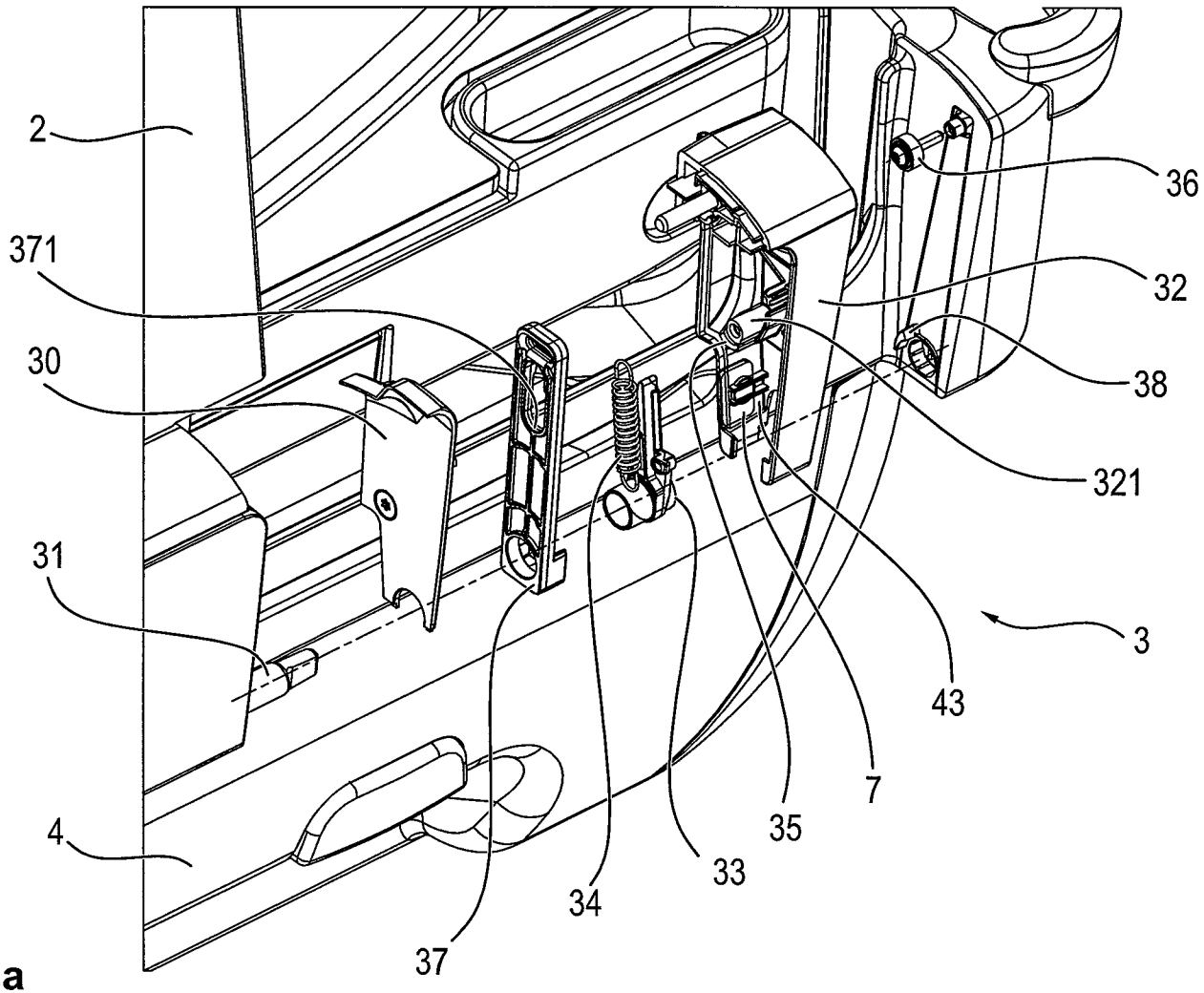
FIG. 2*a* is an exploded schematic view of a pivoting device.

FIG. 2*a* shows the pivoting device 3 in an exploded schematic view. The pivoting device 3 comprises a pivoting axis section 31, about which the pivoting device 3 and the pivotable wall 2 connected to the pivoting device 3 can be pivoted.

A radial guide element 37 is mounted rotatably in relation to the pivoting axis section 31. The radial guide element 37 comprises a guide groove 371. A pin 321 of a locking element 32 meshes with the guide groove 371. In this case, the pin 321 is permanently connected to the locking element 32, so that the locking element 32 is mounted pivotably radially in relation to the pivoting axis section 31. Further, the locking element 32 is connected to the pivotable wall 2. Further, near the pivoting axis section 31, the locking element 32 comprises a slide bearing, which is configured in the form of a guide surface 43 at the radial guide element 37. Combined with the guide groove 371 with the pin 321, the locking element 32 is thus guided along the radial guide element 37 at two radial positions in relation to the pivoting axis section 31. A stable guiding of the locking element 32 at the radial guide element 37 is thus brought about. The locking element 32 can thus be guided along the guide groove 371 at the radial guide element 37. In this case, the guide groove 371 defines the freedom of motion of the locking element 32 in the radial direction in relation to the pivoting axis section 31. Further, the locking element 32 is mounted pivotably on the pivoting axis section 31 via the radial guide element 37. The pivotable mounting of the locking element 32 is thus brought about by the mounting at the radial guide element 37.

Figure 2B:
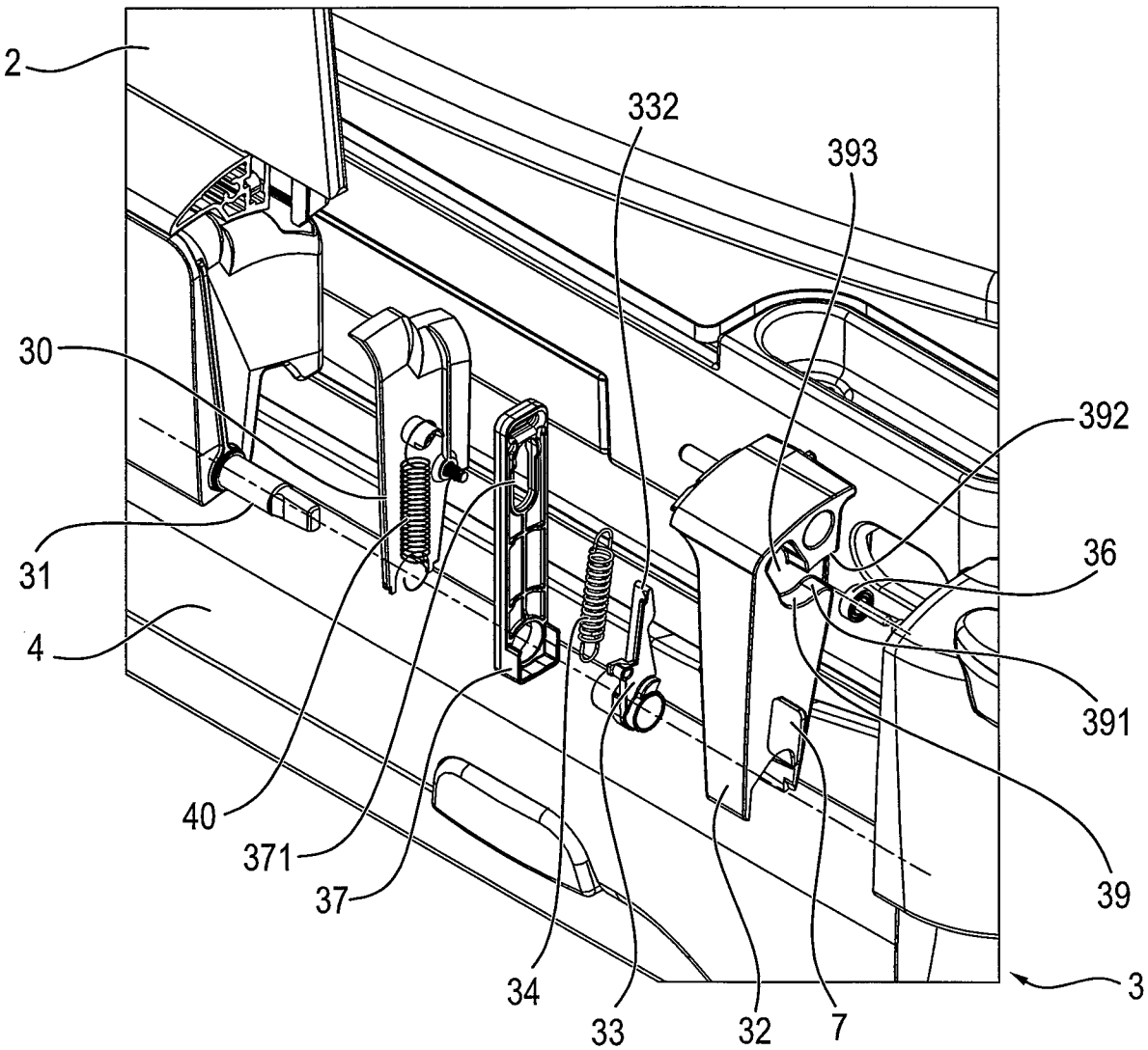
FIG. 2*b* is another exploded schematic view of the pivoting device.

According to FIG. 2*b*, the locking element 32 comprises a sliding guide element 39. The sliding guide element 39 is used as a guide for a bolt element 36, which is configured as a ball bearing. The bolt element 36 is permanently connected to the thermotherapy device 1, i.e., the locking element 32 is guided by the sliding guide element 39 when the bolt element 36 meshes with the sliding guide element 39. The sliding guide element 39 further has a closed end 393 and an open end 392. When the bolt element 36 is arranged at the closed end 393, the pivoting device is in the locked position. Starting from the closed end 393, the sliding guide element 39 guides obliquely downwards in the direction of the thermotherapy device 1, i.e., the locking element 32 can only be moved upwards obliquely away from the thermotherapy device 1. Thus, the pivotable wall 2 connected to the locking element 32 can also be moved from the locked position in this direction only.

The pivoting device 3 further comprises a blocking element 33, which is mounted pivotably on the pivoting axis section 31. The blocking element 33 is connected to the locking element 32 via a holding module 34. The holding module 34 is configured as a tension spring, which acts on the blocking element 33 at a lever piece 331 acting eccentrically towards the pivoting axis section 31. As soon as the locking device 32 is moved away from the pivoting axis section 31 with a motion that comprises a radial component, the tension spring is tensioned, so that the holding module 34 exerts a torque onto the blocking element 33. The blocking element 33 is pushed in the direction of the thermotherapy device 1 by the torque.

Here, the locking element 32 comprises a contact element 34 in the form of a contact collar, which is made tangential to the axis of the pivoting axis section 31. The contact element 35 is arranged closer to the thermotherapy device 1 in the locked position in relation to the blocking element 33. In this case, the blocking element 33 is pushed by the holding module 34 between the pivoting axis section 31 and the contact element 35.

At the pivoting axis section 31 is arranged a retaining element 38 that retains the blocking element 33 when it is pushed by the holding module 34 between the contact element 35 and the pivoting axis section 31 before reaching the pivoted position. The blocking element 33 is thus not yet arranged between the contact element 35 and the pivoting axis section 31 solely by the pushing of the holding module 34. The blocking element 33 is arranged between the contact element 35 and the pivoting axis section 31 only after the locking element 32 has been moved into the pivoted position via the unlocked position.

Accordingly, as soon as the locking element 32 was moved far enough from the locked position about the pivoting axis section 31, the blocking element 33 is arranged between the contact element 35 and the pivoting axis section 31. In this connection, the locking element 32 is moved towards the blocking element 33, so that the locking element 32 arranges the contact element 35 above the blocking element 33 as viewed from the pivoting axis section 31. In this way, the blocking element 33 is arranged between the pivoting axis section 31 and the contact element 35. Due to this arrangement, the locking element 32 can only still be moved up to the blocking element 33 in the direction of the pivoting axis section 31. A further motion in the direction of the pivoting axis section 31 cannot take place because of the blocking element 33 and the positive-locking contact of the blocking element 33 at the contact element 35.

The blocking element 33 can be configured in an alternative embodiment such that it also blocks a motion of the locking element 32 away from the pivoting axis section 31. The blocking element 33 may have, for this, a laterally arranged projection which meshes with a recess at the locking element 32 and thereby brings about a positive locking in the radial direction in relation to the pivoting axis section 31. The blocking action may, however, also take place in a nonpositive locking manner.

The pivoting device 3 further comprises a pulling module 40, which connects the locking element 32 to the pivoting axis section 31. In case of a displacement of the locking element 32 away from the pivoting axis section 31, the pulling module 40 brings about a tensile force, which pulls the locking element 32 towards the pivoting axis section 31. The tensile force of the pulling module 40 is so high in this case that it overcompensates the weight of the pivotable wall 2, i.e., the tensile force of the pulling module 40 is greater than the weight of the pivotable wall 2 together with the pivoting device 3 and other components connected to the pivotable wall 2. As a result, it causes the pulling module 40 to increase the closing force of the pivotable wall in the closed state of the pivotable wall 2. When the pivotable wall 2 is fully open and the pivoting axis section 31 is arranged above the pivotable wall 2, the pulling module 40 causes the pivotable wall 2 to be pulled further towards the pivoting axis section 31. The locking element 32 thus continues to remain placed against the blocking element 33. Further, a rattling of the pivotable wall 2 and a displacement of the pivotable wall 2 away from the pivoting axis section 31 are thereby avoided. The closing of the pivotable wall 2 is thereby facilitated because the bolt element 36 can be inserted into the sliding guide element 39 alone due to the closing operation of the pivotable wall 2 without the user having to move the pivotable wall 2 in the radial direction in relation to the pivoting axis section 31.

The pulling module 40 and the holding module 34 are shown in FIG. 2*b*. Moreover, the holding module 34 and the pulling module 40 are made in one piece. The tension spring acts in this case in combination with the pawl simultaneously as a blocking element 33 and as a holding module 34. The holding module 34 thus not only exerts a pushing torque onto the blocking element 33, but also exerts a tensile force onto the locking element 32, which force presses the locking element 32 with the contact element 34 onto the blocking element 33, so that a radial motion of the pivotable wall 2 is prevented.

Figure 3:
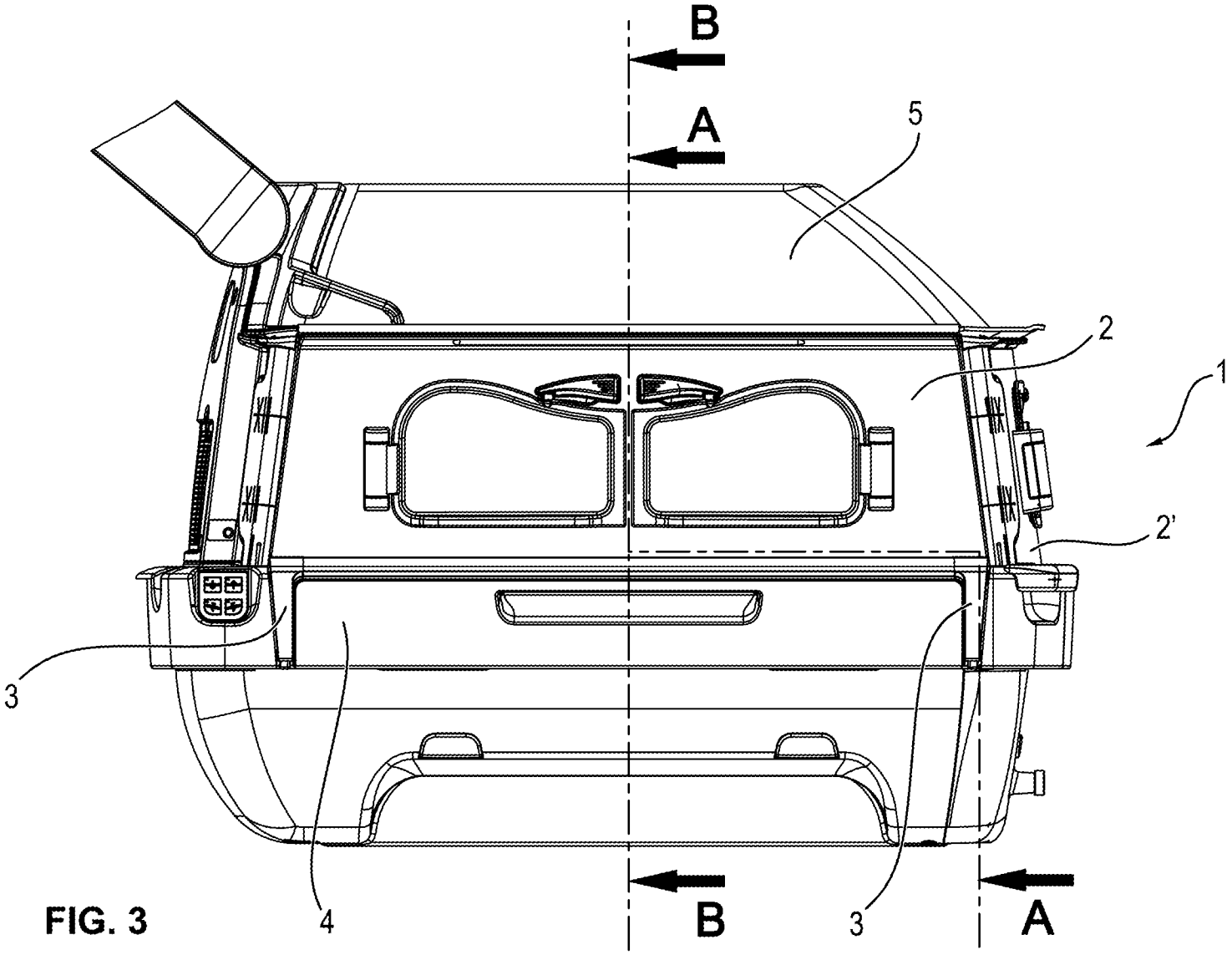
FIG. 3 is a schematic lateral view of a thermotherapy device.

The action of the blocking element 33 is explained in greater detail below. According to the lateral view of a thermotherapy device 1 in FIG. 3, sectional views along line A-A and line B-B are described for this purpose. The section through A-A shows a section through a pivoting device 3. The section B-B represents a section at the level of the X-ray flap 4.

The section through line A-A is shown in FIGS. 4*a-d*. FIGS. 4*a-d* show various closed and opened states of the pivotable wall 2 and of the pivoting device 3.

Figure 4A:
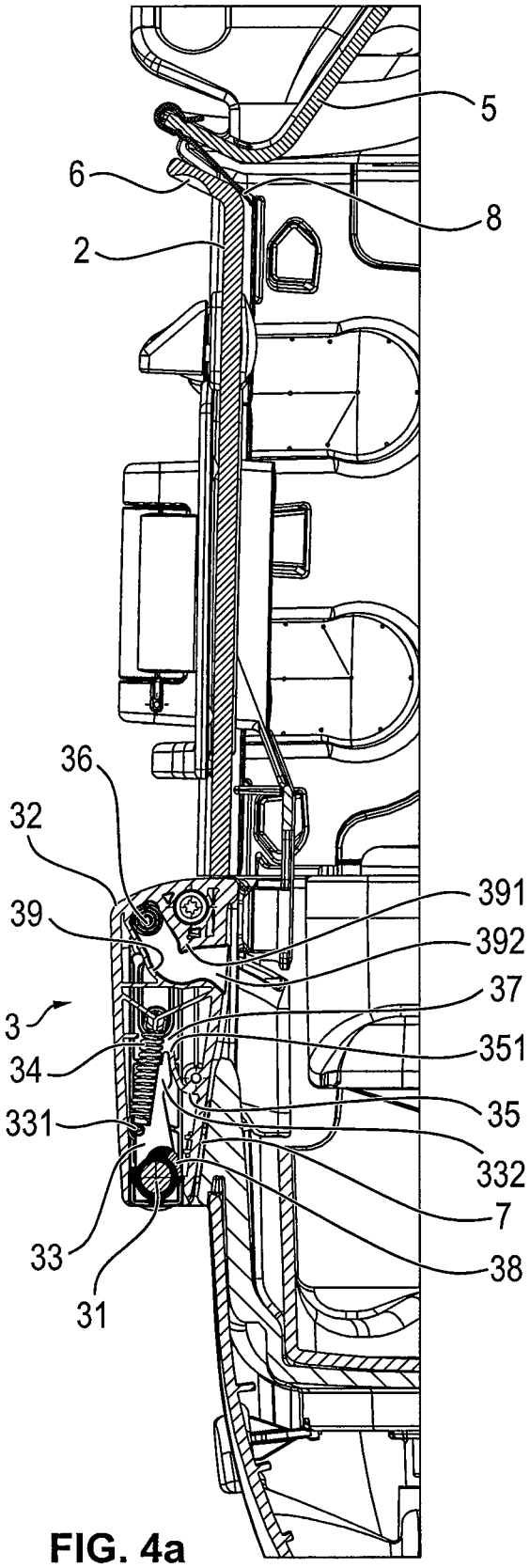
FIG. 4*a* is a sectional view at position A-A through FIG. 3 in one of various positions of the pivotable wall or of the locking element.

FIG. 4*a* shows the pivotable wall 2, which, with its upper end, is in contact with a sealing lip 8 of a hood 5 of a thermotherapy device 1. A pivoting device 3, which connects the pivotable wall 2 to the thermotherapy device 1, is fastened at the opposite end of the pivotable wall 2. The pivotable wall 2 can be pivoted by means of the pivoting device 3. The pivoting takes place here about the axis of the pivoting axis section 31. FIG. 4*a* shows the locked position of the locking element 32. The bolt element 36, which is configured as a ball bearing, is arranged at the closed end 393 of the sliding guide element 39. The weight of the pivotable wall 2 and the pulling module 40 press the locking element 32 with the closed end 393 of the sliding guide element 39 onto the bolt element 36.

The blocking element 33 is arranged in this position with its upper end 332 above the contact element 35 at a guide rib 351. The guide rib 351 ensures that the blocking element 33 is arranged at the contact element 35 during a pivoting of the locking element 32. Thus, a getting caught up of the blocking element 33 at the locking element 32 is prevented by means of the guide rib 351 before the blocking element 33 is arranged at the contact element 35. Further, the blocking element 33 in its pivotability is blocked by the retaining element 38. Thus, the blocking element 33 cannot be pivoted further towards the thermotherapy device 1. Hence, the blocking element 33 in the locked position has a different angular orientation than the locking element 32.

The pivotable wall 2 is guided obliquely upwards to the left due to a pivoting of the pivotable wall 2 away from the thermotherapy device 1 because of the connection to the locking element 32 via the sliding guide element 39. The guiding here takes place by means of the bolt element 36, which is permanently connected to the thermotherapy device 1. In this connection, the locking element 32 is guided out of the locked position.

Figure 4B:
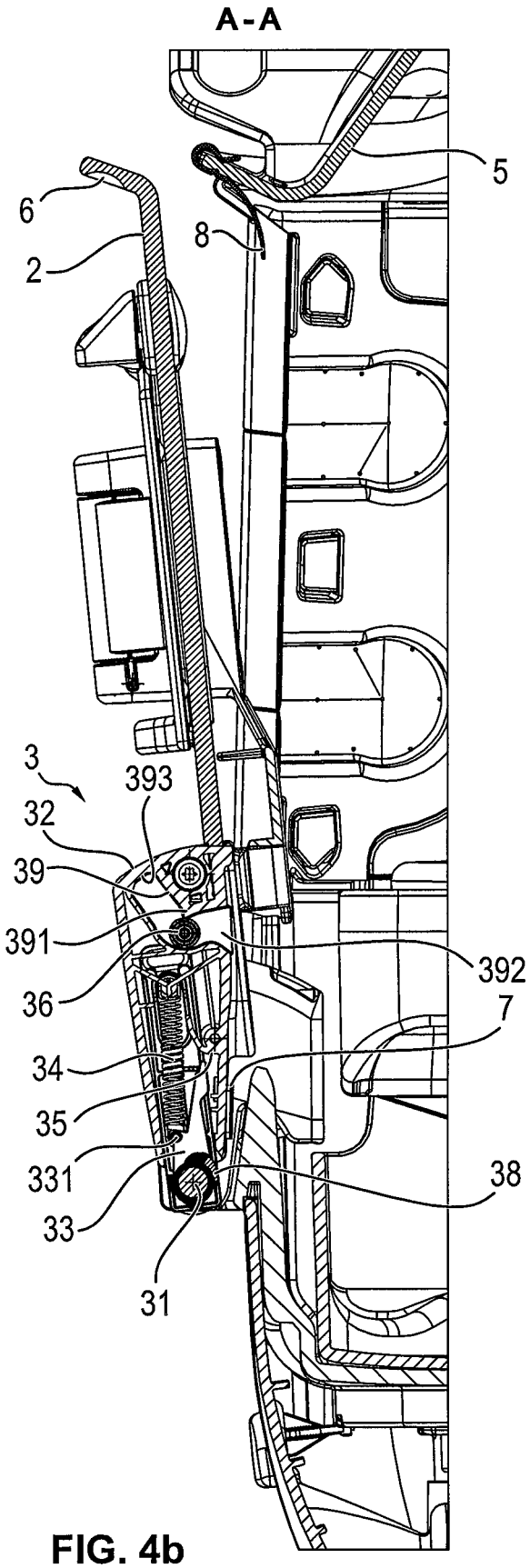
FIG. 4*b* is a sectional view at position A-A through FIG. 3 in another of various positions of the pivotable wall or of the locking element.

Shortly before the bolt element 36 reaches the unlocked position shown in FIG. 4*b*, the bolt element 36 passes an instability element 391 in the sliding guide element 39, which instability element acts as a dead center of the motion of the pivotable wall 2 and of the pivoting device 3. The instability element 391 is configured as an acute angle at the sliding guide element 39. When the motion of the locking element 32 is stopped in the state when the bolt element 36 is in contact with the instability element 391, the instability element 391 causes the locking element 32 to be pushed with the pivotable wall 2 either back into the locked position or into the unlocked position, i.e., the pivotable wall 2 at the dead center, i.e., when the instability element 391 is in contact with the bolt element 36, is either again pivoted into the locked position, i.e., the pivotable wall 2 is again in contact with the thermotherapy device 1, or the pivotable wall 2 is further removed from the thermotherapy device 1 in a pivoting motion due to gravity.

In the unlocked position, the pivotable wall 2 can be pivoted about the pivoting axis without further motion away from the pivoting axis section 31. The bolt element 36 must hence be unthreaded along the sliding guide element 39 during a motion of the pivotable wall 2.

In the unlocked position shown in FIG. 4*b*, it is further shown that the holding module 34 exerts a torque onto the blocking element 33, which acts on the blocking element 33. The torque pushes the blocking element 33 into the direction of the thermotherapy device 1 or between the pivoting axis section 31 and the contact element 35, which is arranged in the unlocked position above the upper end 332 of the blocking element 33. Due to the motion of the pivotable wall 2 obliquely upwards, the contact element 35 was likewise moved obliquely upwards, so that it reached the unlocked position above the upper end 332 of the blocking element 33.

Figure 4C:
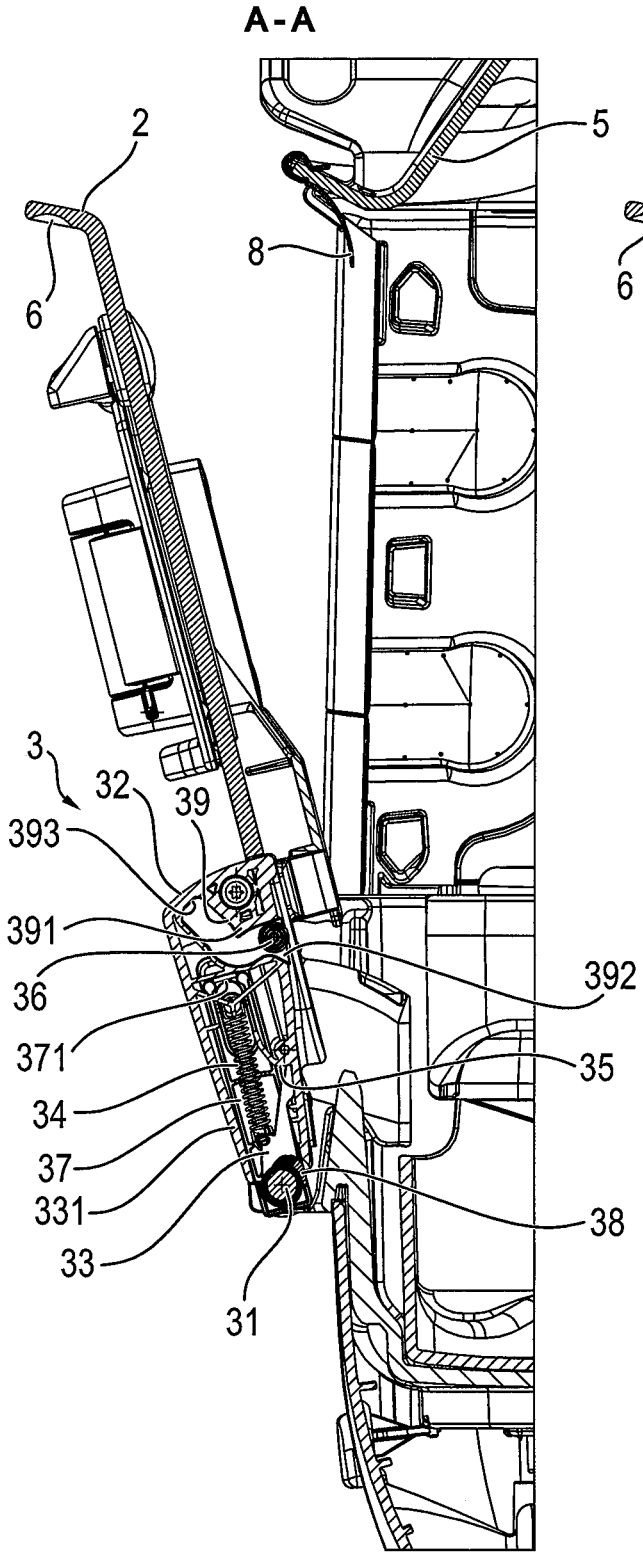
FIG. 4*c* is a sectional view at position A-A through FIG. 3 in another of various positions of the pivotable wall or of the locking element.

FIG. 4*c* shows the pivotable side wall 2 in the pivoted position. In this case, the bolt element 36 is arranged at the open end of the sliding guide element 39. In this position, the pivotable side wall 2 can hence be freely pivoted about the pivoting axis, which is defined by the pivoting axis section 31. Further, the contact element 35 rests on the upper end 332 of the blocking element 33, so that the blocking element 33 is arranged between the pivoting axis section 31 and the contact element 35. In this connection, the blocking element 33 is still in the same position as shown in FIGS. 4*a* and 4*b*. In case of a further pivoting of the locking element 32 or of the pivotable wall 2 away from the thermotherapy device 1, the blocking element 33 is carried along by the locking element 32, i.e., the blocking element 33 is likewise pivoted about the pivoting axis section 31 in case of a further pivoting of the pivotable wall 2. During the further pivoting, the holding module 334 here continually exerts a torque onto the blocking element 33 such that the blocking element 33 is pushed between the pivoting axis section 31 and the contact element 35.

Figure 4D:
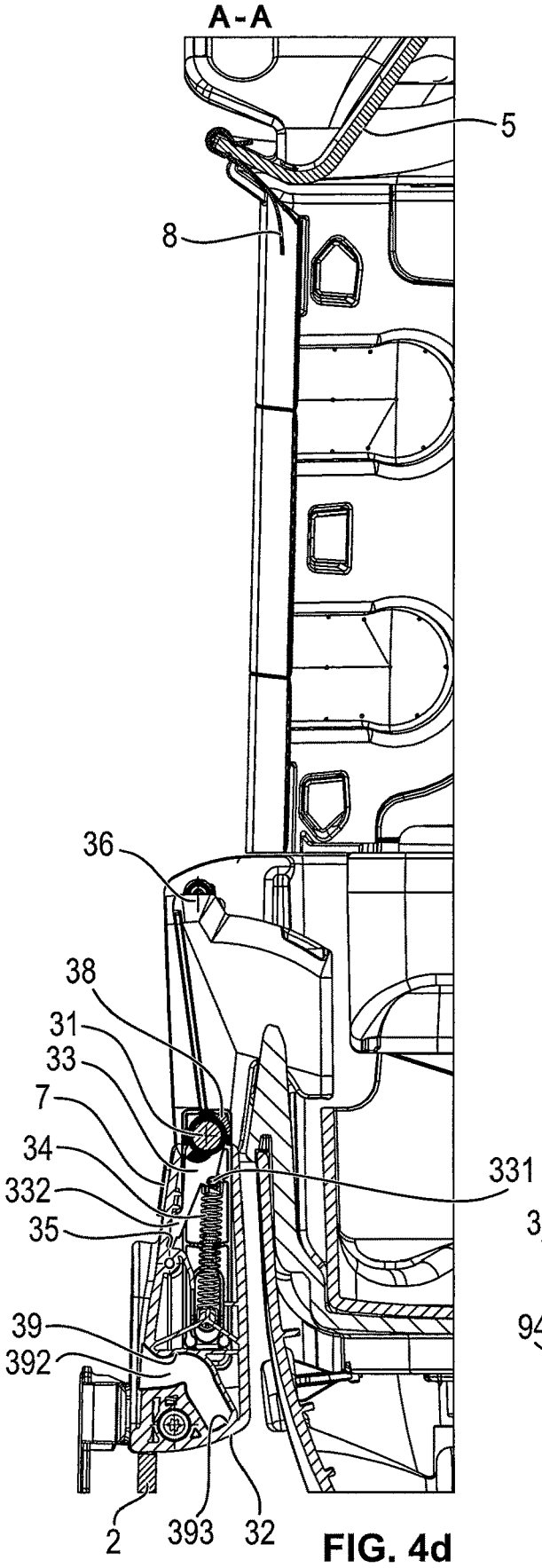
FIG. 4*d* is a sectional view at position A-A through FIG. 3 in another of various positions of the pivotable wall or of the locking element.

Starting from the unlocked position, the contact element 35 is deposited onto the blocking element 33 by the guiding of the sliding guide element 39 along the bolt element 36. A further motion of the pivotable wall 2 in the direction of the pivoting axis section 31 is prevented by the blocking element 33. The pivotable wall 2 thus remains at the same distance to the pivoting axis section 31 after the pivoting from the pivoted position away from the thermotherapy device 1. FIG. 4*d* shows this state. The locking element 32 is arranged above the pivotable wall 2 here. In spite of the weight, which acts on the holding module 34 due to the pivotable wall 2, the blocking element 33 is pushed further between the contact element 35 and the pivoting axis section 31, on the one hand, and the contact element 35 is pressed against the blocking element 33, on the other hand.

Figure 5A:
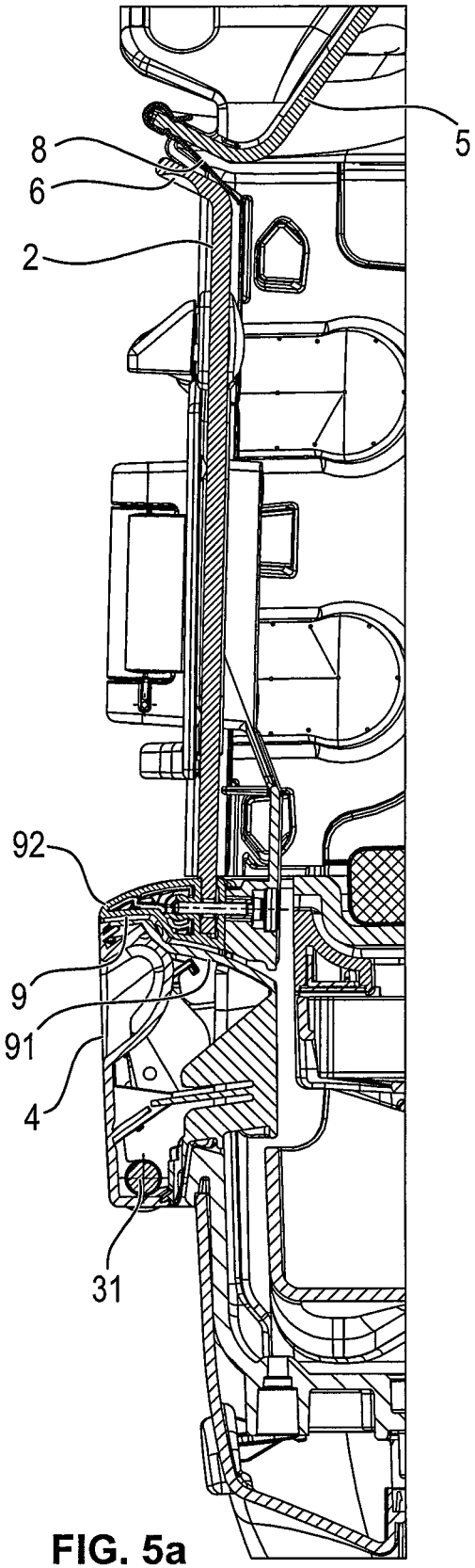
FIG. 5*a* is a sectional view at position B-B through FIG. 3 in one of various positions of the pivotable wall.

The X-ray flap 4 is likewise pivoted about the pivoting axis section 31 according to FIG. 5*a*. A gap remains between the pivotable wall 2 and the X-ray flap 4 in case of this arrangement. The interior of the thermotherapy device 1 is connected to the surrounding area by this gap. Hence, this gap must be sealed. This is carried out in the form of a labyrinth seal 9 according to FIG. 5*a*. For this, the X-ray flap 4 has a bottom part 91 of the labyrinth seal 9, which is made in one piece with the top side of the X-ray flap 4. A cover part 92, which has a shape complementary to the bottom part 91, is arranged at the pivotable wall 2. The combination of the bottom part 91 and of the cover part 92 in contact with one another forms the labyrinth seal 9.

Figure 5B:
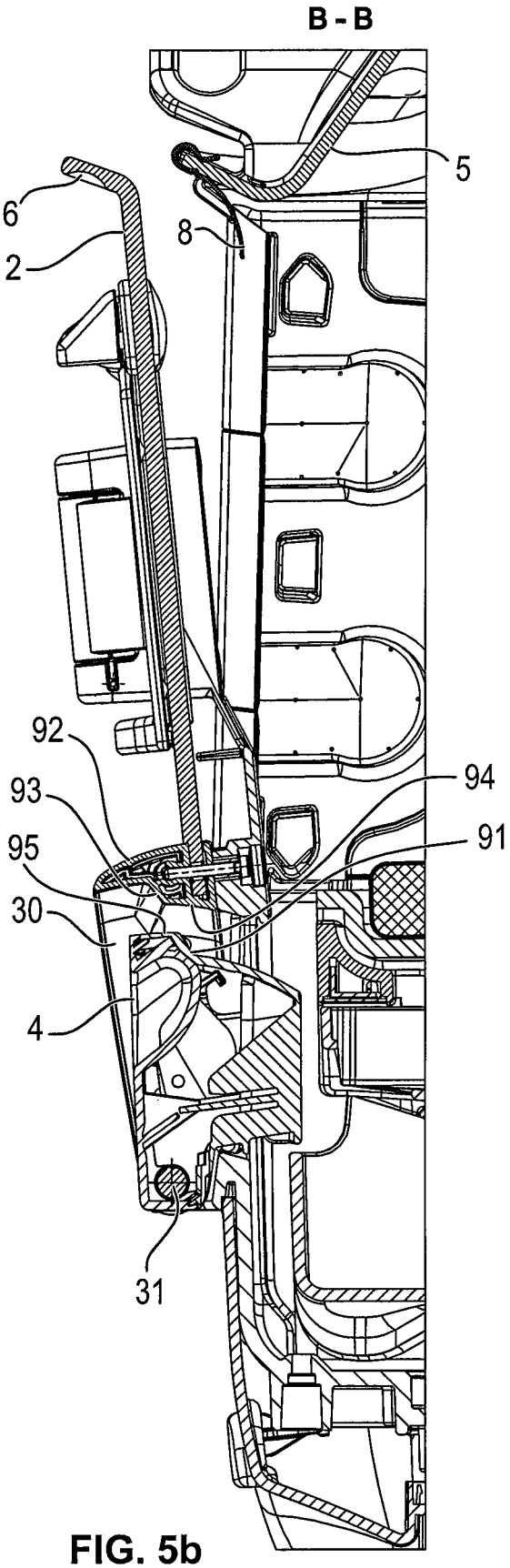
FIG. 5*b* is a sectional view at position B-B through FIG. 3 in another of various positions of the pivotable wall.

The labyrinth seal 9 comprises at the cover part 92 an oblique section 93 that is sloped at the same angle as the sliding guide element 39 between the locked position and the unlocked position. As a result, the cover part 92 of the labyrinth seal 9 is moved parallel to the oblique section 93 along the bottom part 91 during the raising of the pivotable wall 2 in the guided motion by the sliding guide element 39, without a positive locking forming between the bottom part 91 and the cover part 92 (see FIG. 5*b*).

Figure 5C:
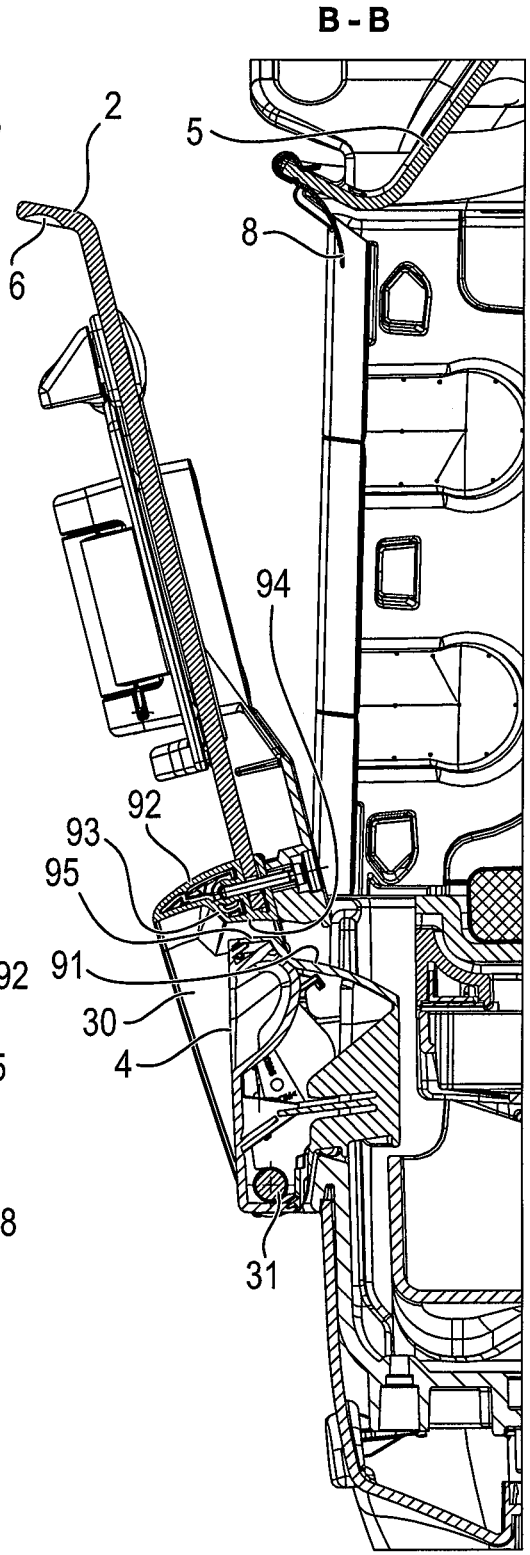
FIG. 5*c* is a sectional view at position B-B through FIG. 3 in another of various positions of the pivotable wall.

An inner section 94 of the cover part 92 of the labyrinth seal 9 is raised above the outer section 95 of the cover part 91 of the X-ray flap 4 during the transfer of the pivotable wall 2 from the locked position into the unlocked position. During a pivoting of the pivotable wall 2 about the pivoting axis section 31, the cover part 2 of the labyrinth seal 9 can be pivoted about the X-ray flap 4 according to FIG. 5*c*.

Figure 5D:
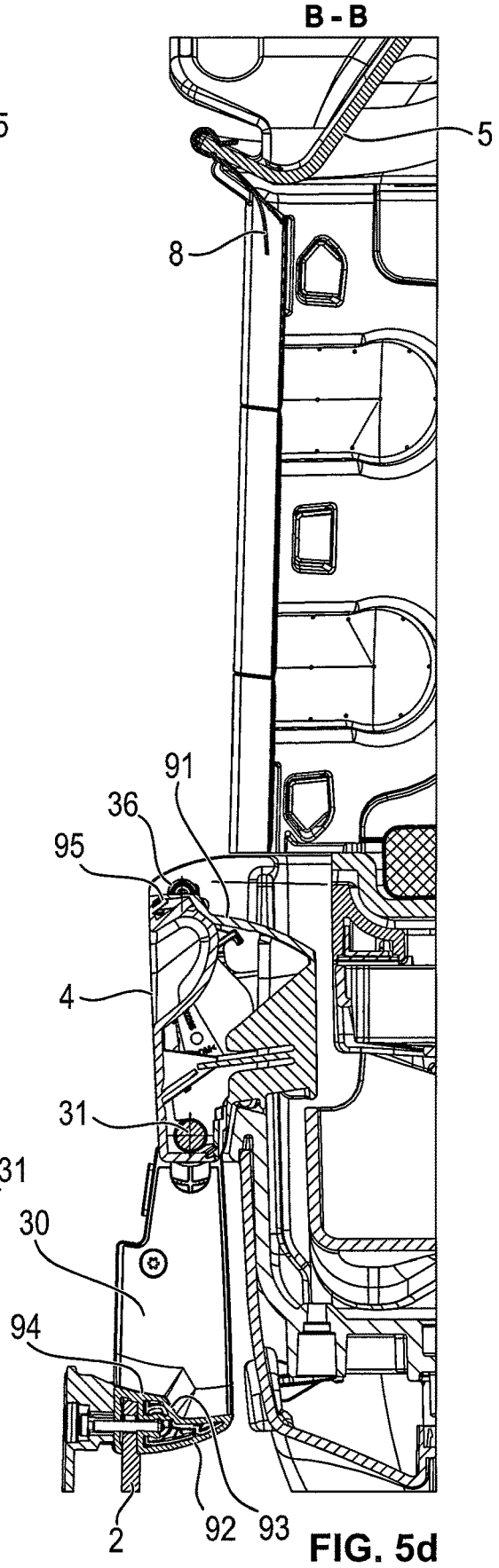
FIG. 5*d* is a sectional view at position B-B through FIG. 3 in another of various positions of the pivotable wall.

The X-ray flap 4 is free from the cover part 92 of the labyrinth seal 9 in FIG. 5*d*. Since the pivotable wall 2 now no longer brings about any limitation of the interior of the thermotherapy device 1, a seal between the X-ray flap 4 and the pivotable wall 2 is also no longer needed. The labyrinth seal 9 is hence no longer included in FIG. 5*d*.

When the pivotable wall 2 shall be pivoted from the pivoted position back into the locked position, the steps according to FIGS. 4*a-d* and 5*a-d* are passed through in reverse sequence.

Starting from the state in FIG. 4*d*, the pivotable wall 2 is pivoted at a constant distance about the pivoting axis section 31 because of the blocking element 33 until the bolt element 36 is arranged in the open end 392. Because of the holding module 34, the blocking element 33 is pressed against the locking element 32 during the pivoting operation into the pivoted position and remains between the pivoting axis section 31 and the contact element 35.

As can be seen from the transition from FIG. 4*c* to FIG. 4*b*, the blocking element 33 is removed from the position between the pivoting axis section 31 and the contact element 35 by the retaining element 38 in case of a further pivoting of the pivotable wall 2 into the unlocked position in spite of the still acting torque of the holding module 34. So that the blocking element 33 can be detached from the contact element 35 by the retaining element 38 without tilting or getting caught up, the locking element 32 is moved above the sliding guide element 39 at the instability part 391 in the radial direction away from the pivoting axis section 31. As a result, the contact element 35 loses the positive-locking contact with the blocking element 33. Thus, a disturbance-free actuation of the blocking element 33 is made possible by the retaining element 38. Further, the locking element 32 is thereby again movable in the radial direction of motion towards the pivoting axis section 31.

In case of a further motion of the pivotable wall 2 into the direction of the locked position, the bolt element 36 is arranged in the closed end 393 of the sliding guide element 39. From the view shown in FIG. 4*a*, the pivotable wall 2 is hereby lowered obliquely downwards to the right. In this case, the contact element 35 is arranged below the upper end of the blocking element 33. Further, the pivotable wall 2 is pressed with the upper end against the sealing lip 8, which is arranged at the hood 5. Thus, the pivotable wall 2 in the locked position closes the interior of the thermotherapy device 1.

In a first preferred embodiment, the locking element 32 may be configured as a housing part. The blocking element 33, the holding module 34, the contact element 35 and the radial guide element 37 are arranged within this housing part in this case. The housing is closed by a housing cover 30 (see FIG. 2*a* or 2*b*). The mechanism is thereby protected against contamination and against interfering forces from outside.

Figure 6:
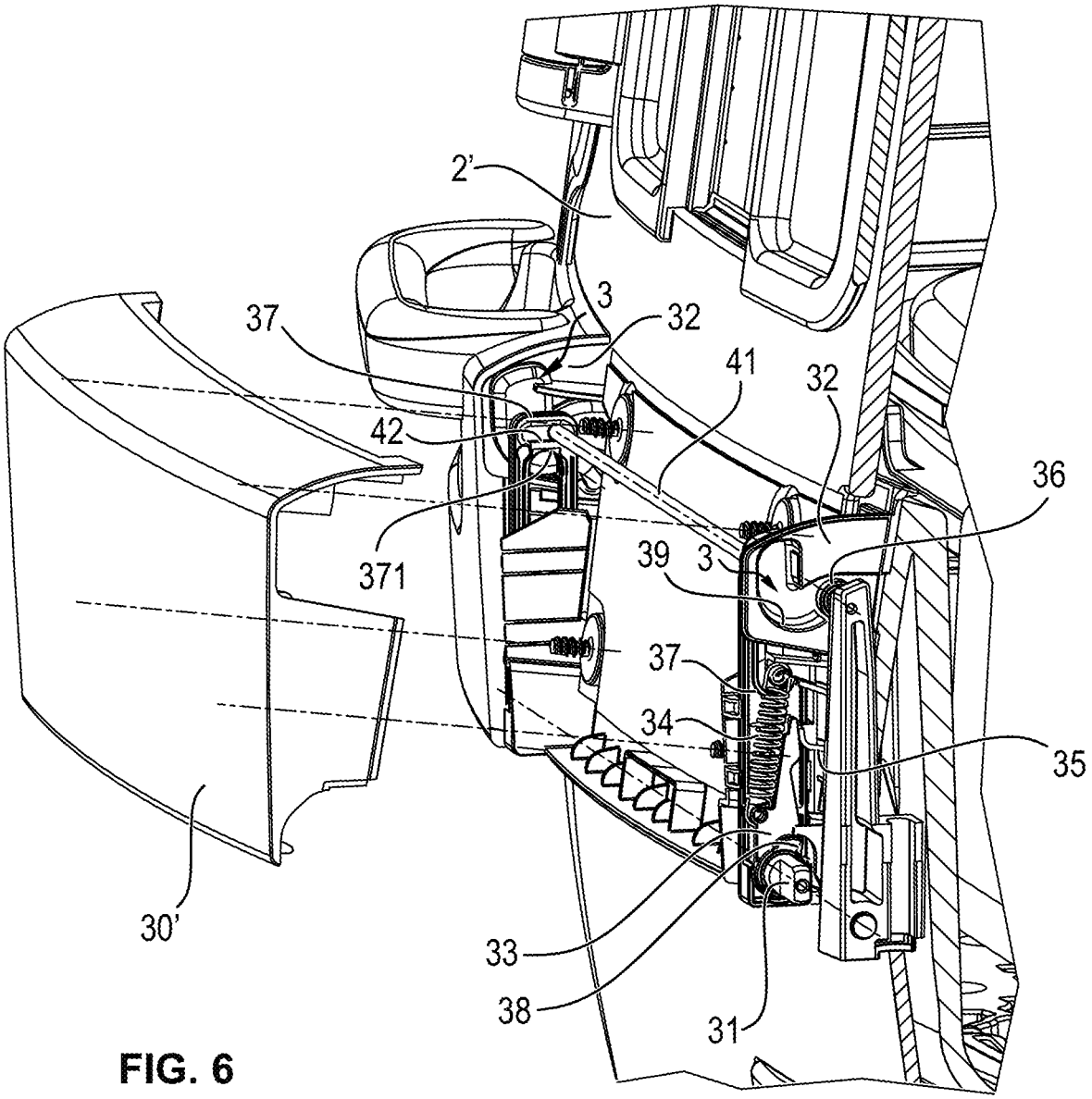
FIG. 6 is a schematic view of an alternative embodiment of the pivoting device.

In an alternative embodiment according to FIG. 6, a southern pivotable wall 2' comprises two pivoting devices 3, which have a common housing cover 30'. Further, FIG. 6 shows a sliding guide element 39, which does not guide the pivotable wall 2' obliquely upwards from the thermotherapy device 1. Instead, the southern pivotable wall 2' is guided essentially vertically upwards in order to reach the unlocked position from the locked position. For this, the hood 5 is raised a little, so that the southern pivotable wall 2' can be raised by the distance between the locked position and the unlocked position. After that, the southern pivotable wall 2' can be pivoted and the hood 5 can again be placed onto the thermotherapy device 1.

In FIG. 6, the southern pivotable wall 2' is connected to the thermotherapy device 1 by means of two pivoting devices 3. In order to avoid a tilting of the pivoting devices 3 during the raising of the southern pivotable wall 2', the pivoting devices 3 are connected to one another by means of a coupling element 41. In this case, the coupling element 41 acts on the radial guide elements 37 of the two pivoting devices 3 in guide tracks 42 running tangentially to the pivoting axis section 31. The coupling element 41 may be configured here as a crankshaft, which is further rotatably mounted at the locking elements 32 of the two pivoting devices 3. The motion of the southern pivotable wall 2' is transferred synchronously to the two pivoting devices 3 by means of the coupling element 41. Even if the pivotable wall 2' shall become entangled about the axis of the normal of the wall plane, the locking elements 32 of the two pivoting devices 3 are synchronously moved away from the pivoting axis section 31 because of the coupling element 41. A tilting of the locking elements 32 due to an "oblique" raising of the pivotable wall 2' is thus avoided. The coupling element 41 hence guides the locking elements 32 parallel during a raising of the pivotable wall 2', even if the pivotable wall 2' is not raised centrally but rather offset between the pivoting devices 3. The pivotable wall 2' is thus certainly raised parallel to the thermotherapy device 1.

While specific embodiments of the invention have been shown and described in detail to illustrate the application of the principles of the invention, it will be understood that the invention may be embodied otherwise without departing from such principles.

APPENDIX

List of Reference Numbers

1 Thermotherapy device
2 Pivotable wall
2' Southern pivotable wall
3 Pivoting device
4 X-ray flap
5 Hood
6 Handle
7 Damping element
8 Sealing lip
9 Labyrinth seal
30 Housing cover
30' Southern housing cover
31 Pivoting axis section
32 Locking element
33 Blocking element
34 Holding module
35 Contact element
36 Bolt element
37 Radial guide element
38 Retaining element
39 Sliding guide element
40 Pulling module
41 Coupling element
42 Guide track
43 Guide surface
91 Bottom part
92 Cover part
93 Oblique section
94 Inner section
95 Outer section
321 Pin
331 Lever piece
332 Upper end of the blocking element
351 Guide rib
371 Guide groove
391 Instability part
392 Open end of the sliding guide element
393 Closed end of the sliding guide element

What is claimed is:

1. A thermotherapy device comprising: a pivotable wall; a pivoting device for pivoting the pivotable wall, the pivoting device comprising: a pivoting axis section connected to the thermotherapy device; a locking element connected to the pivotable wall, the locking element being mounted movably radially to the pivoting axis section and pivotably about the pivoting axis section; a blocking element; a holding module for holding the blocking element; and a contact element fixed to the locking element, the contact element configured for contacting the blocking element such that the blocking element blocks pivoting movement of the locking element and the pivotable wall in a locked position of the locking element, the holding module pushing the blocking element between the pivoting axis section and the contact element as the locking element is moved from the locked position, defined by a first distance of the locking element to the pivoting axis section, into an unlocked position, defined by a second distance of the locking element to the pivoting axis section, wherein in the unlocked position the blocking element does not block pivoting movement of the locking element and the pivoting wall, wherein with the locking element in the unlocked position, the locking element and the pivotable wall are configured to pivot about the pivoting axis section.

2. A thermotherapy device in accordance with claim 1, wherein the first distance is shorter than the second distance.

3. A thermotherapy device in accordance with claim 1, wherein the pivoting device comprises a radial guide element for guiding the locking element in the radial direction in relation to the pivoting axis section, the radial guide element being mounted pivotably about the pivoting axis section.

4. A thermotherapy device in accordance with claim 1, wherein:

a bolt element is permanently connected to the thermotherapy device; and the locking element comprises a sliding guide element for guiding the bolt element.

5. A thermotherapy device in accordance with claim 1, wherein:

a bolt element is permanently connected to the locking element; and the thermotherapy device comprises a sliding guide element for guiding the bolt element.

6. A thermotherapy device in accordance with claim 1, wherein:

a bolt element is fixed to either the thermotherapy device or the locking element;

the locking element or the thermotherapy device comprises a sliding guide element for guiding the bolt element;

the sliding guide element has an open end and a closed end; and between the open end and the closed end an instability element is arranged, which instability element pushes the locking element either into the locked position or into the unlocked position during arrangement at the bolt element.

7. A thermotherapy device in accordance with claim 6, wherein the bolt element is configured as a ball bearing.

8. A thermotherapy device in accordance with claim 1, wherein the pivoting device further comprises a damping element for damping a motion of the locking element at the thermotherapy device.

9. A thermotherapy device in accordance with claim 1, wherein the pivoting device further comprises a retaining element configured for blocking a pivoting motion of the blocking element before reaching the locked position.

10. A thermotherapy device in accordance with claim 1, wherein:

the blocking element is mounted pivotably about the pivoting axis section;

the holding module is configured as a tension spring acting on a lever piece of the blocking element; and the lever piece is arranged eccentrically to the pivoting axis section.

11. A thermotherapy device in accordance with claim 1, further comprising a pulling module biasing the pivotable wall towards the pivoting axis section by a tensile force that is greater than a weight of the pivotable wall, wherein the pulling module is connected with the holding module.

12. A thermotherapy device in accordance with claim 1, wherein the blocking element is configured as a pawl.

13. A thermotherapy device in accordance with claim 1, wherein the locking element is configured as a hinge housing part.

14. A thermotherapy device in accordance with claim 1, further comprising:

an X-ray flap pivotable about the pivoting axis section between the pivoting axis section and the pivotable wall;

a labyrinth seal provided between the X-ray flap and the pivotable wall.

15. A thermotherapy device in accordance with claim 1, further comprising:

a hood, wherein the hood is raisable from the thermotherapy device; and a sealing lip arranged obliquely to the pivotable wall and arranged between the pivotable wall and the hood.

16. A thermotherapy device in accordance with claim 1, wherein the contact element is configured as a contact collar running tangentially to the pivoting axis section.

17. A thermotherapy device in accordance with claim 1, further comprising:

at least another pivoting device whereby at least two pivoting devices are provided for the pivotable wall; and a coupling element configured as a crankshaft, wherein the at least two pivoting devices are connected to one another by the coupling element and the coupling element is slidingly mounted at the pivoting devices in guide tracks running tangentially to the pivoting axis section.

* * * * *